US005826973A

United States Patent [19]

Melzian et al.

[11] Patent Number: 5,826,973

[45] Date of Patent: Oct. 27, 1998

[54] ILLUMINATED DISPLAY WITH UNIFORM LUMINANCE

[76] Inventors: John M. Melzian, 32308 Sea Raven Dr., Rancho Palos Verdes, Calif. 90275; Kenneth A. Zuckerman; Margaret S. Zuckerman, both of 2 El Portal, Palos Verdes Peninsula, Calif. 90274; Daniel A. Schwartz, 6270 Parima St., Long Beach, Calif. 90803

[21] Appl. No.: 528,504

[22] Filed: Sep. 14, 1995

[51] Int. Cl.[6] ..... F21V 7/12

[52] U.S. Cl. ..... 362/297; 362/224; 362/285; 362/307; 362/349; 40/564; 40/762

[58] Field of Search ..... 362/217, 224, 362/260, 297, 329, 330, 331, 346, 349, 367, 812, 304, 305, 307, 362, 285; 40/564, 574, 575, 716, 762, 714, 748, 749, 756

[56] References Cited

U.S. PATENT DOCUMENTS

| | | | |
|---|---|---|---|
| 759,840 | 5/1904 | Brand | 40/749 |
| 1,882,647 | 10/1932 | Kanolt | 40/575 |
| 2,513,576 | 7/1950 | Luray | 40/716 |
| 4,216,936 | 8/1980 | DeSelms | 40/762 |
| 4,701,832 | 10/1987 | Lasker | 362/307 |
| 4,766,685 | 8/1988 | Kramer et al. | 40/574 |
| 4,796,170 | 1/1989 | Pedersen et al. | 40/564 |
| 5,034,864 | 7/1991 | Oe et al. | 362/224 |
| 5,186,537 | 2/1993 | Katoh et al. | 362/260 |
| 5,400,226 | 3/1995 | Hogrefe | 362/297 |

*Primary Examiner*—Alan Cariaso
*Attorney, Agent, or Firm*—Lyon & Lyon LLP

[57] ABSTRACT

An illuminated display is disclosed, comprising a housing, a reflector and a light source for displaying translucent photographic images. The reflector and the light source are specially designed relative to each other to provide uniform luminance on a plane containing the image being displayed. An interchangeable frame and an adjustable positioning structure are used to make the display as functionally practical and as aesthetically pleasing as a conventional picture frame.

15 Claims, 6 Drawing Sheets

ILLUMINATED DISPLAY WITH UNIFORM LUMINANCE

BACKGROUND OF THE INVENTION

1. Field of the Invention

The present invention relates to illuminated displays.

2. Description of the Related Prior Art

Illuminated displays, more commonly known as light boxes, are old in the art. In the past, illuminated displays have been used for viewing photographic negatives, positives, X-rays and the like. They have also been used as tracing tables or as commercial displays. Typically, however, the prior art has contemplated only short term viewing of images. Prior art illuminated displays are not typically designed for the permanent display of a photographic image, much as a conventional photograph mounted in a frame and hung on a wall or placed on a piece of furniture would be. The prior art devices that do contemplate such uses, such as U.S. Pat. No. 1,882,647 issued to Kanolt, are typically bulky and not easily adapted to being adjustably positioned as typical picture frames are.

Furthermore, conventional illuminated displays comprise one or a plurality of light sources placed over a flat or curved reflector and an image located on the side of the light source opposite the reflecting plate. The object is to illuminate the displayed image from behind. However, because of the geometry of the reflector and the location of the light source, conventional illuminated displays, such as Kanolt, typically do not provide uniform luminance distribution across the plane of the image. Luminance is typically highest in the center of the image, close to the light source, and gradually decreases towards the edges of the image.

Attempts have been made to distribute the luminance uniformly within the plane of the image. In U.S. Pat. No. 5,101,331 issued to Katoh, for example, the concentration of light at the center of the image is controlled by a light quantity adjusting means arranged on the surface of the light source or between the light source and the plane of the image. However, this adds an additional component to the device, making it more expensive and more complicated to use. Furthermore, Katoh is directed to an illumination device, not an illuminated display.

The prior art does not disclose an illuminated display where uniform luminance in the plane of the displayed image is provided by optimizing the shape of the reflector. Nor does the prior art disclose an illuminated display with adjustable positioning means and an interchangeable frame which make the display as functionally practical and as aesthetically pleasing as a conventional picture frame.

SUMMARY OF THE PRESENT INVENTION

The present invention is directed to an illuminated display specially designed to provide a uniform distribution of luminance across the plane of the displayed image. The display is as convenient to use as a common picture frame. To this end, the display includes a housing which encloses a light source, a reflector, and several transparent plates between which an image is mounted. The reflector and the light source are designed relative to each other to provide uniform luminance in the plane of the image. Simple electronics power the light source. A base is attached to the housing. Adjustable positioning means secured to the base can be selectively used to position the display on a piece of furniture or to hang it on a wall, much as a conventional picture frame. Finally, an interchangeable picture frame can be selectively superposed over the housing to provide a decorative border for the image.

Accordingly, it is an object of the present invention to provide an illuminated display that is both aesthetically pleasing and practical to use.

It is another object of the present invention to provide an illuminated display that supplies uniformly distributed luminance in the plane of the displayed image.

Other and further objects and advantages of the present invention will appear hereinafter.

DETAILED DESCRIPTION OF THE PREFERRED EMBODIMENT

The preferred embodiment will now be described in detail with reference to the drawings.

Figure 2:
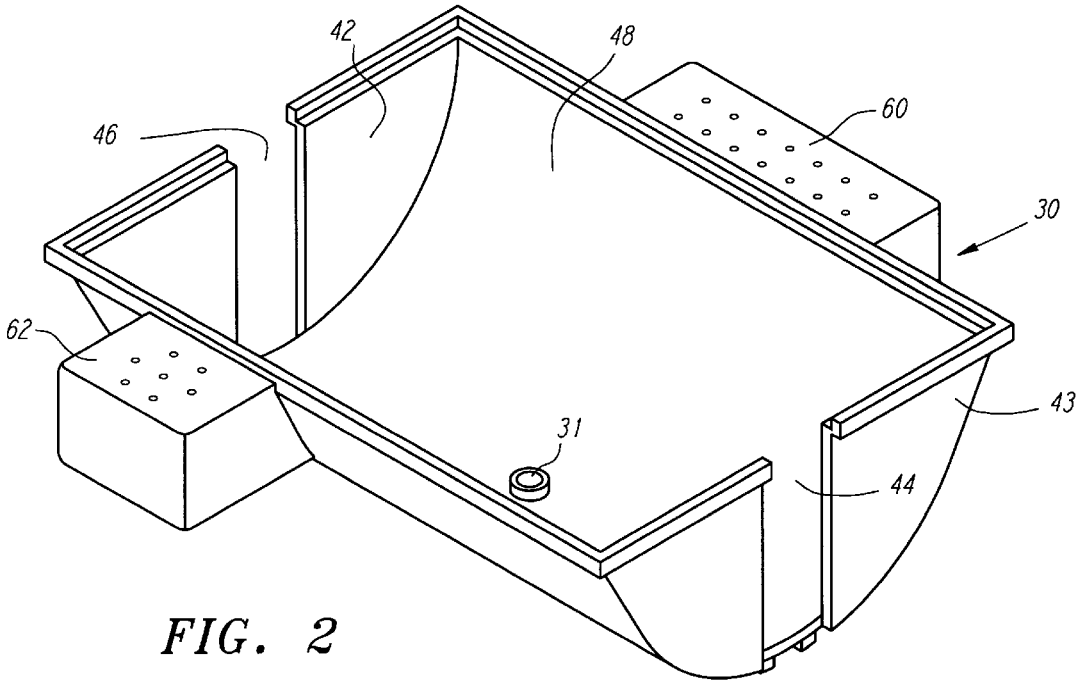
FIG. 2 is a perspective view of the reflector employed by the present invention.
Figure 3:
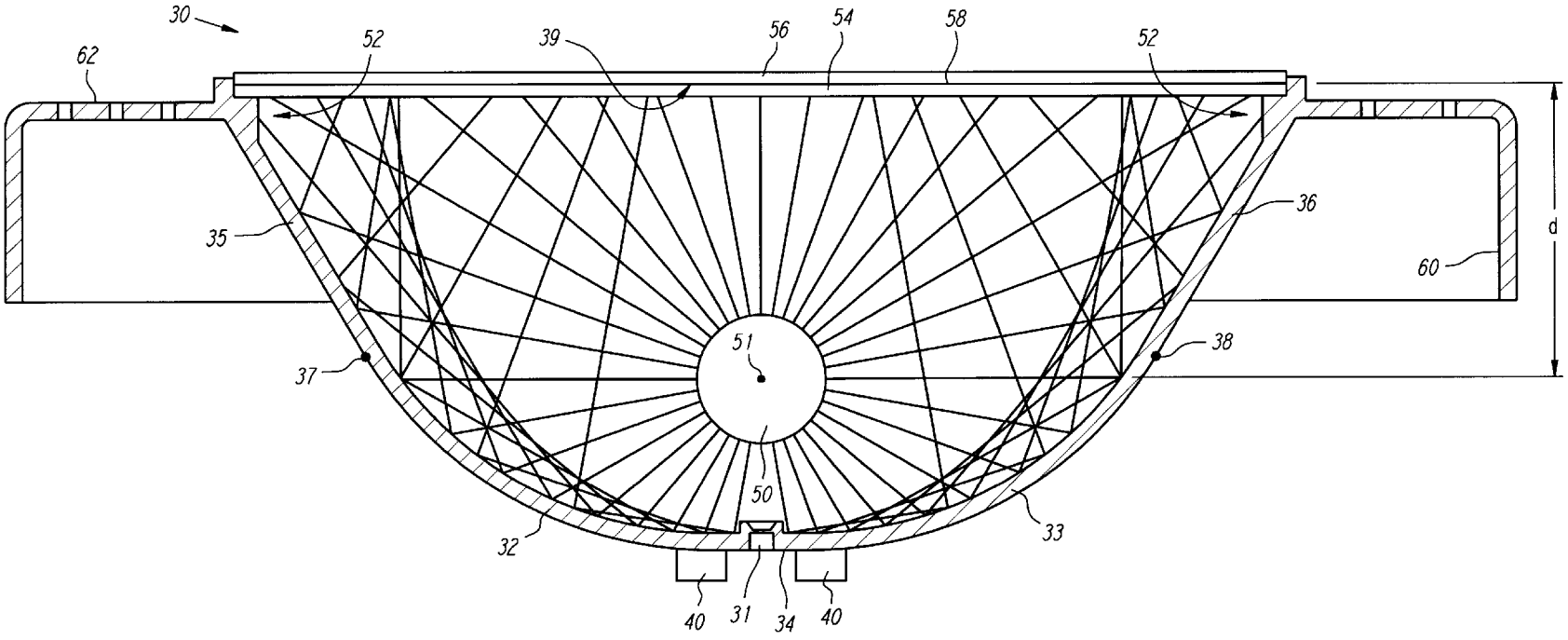
FIG. 3 is a cross-sectional view through the center of the reflector and light source employed by the present invention, showing a schematic of direct and reflected light rays, and the resulting luminance distribution.
Figure 4:
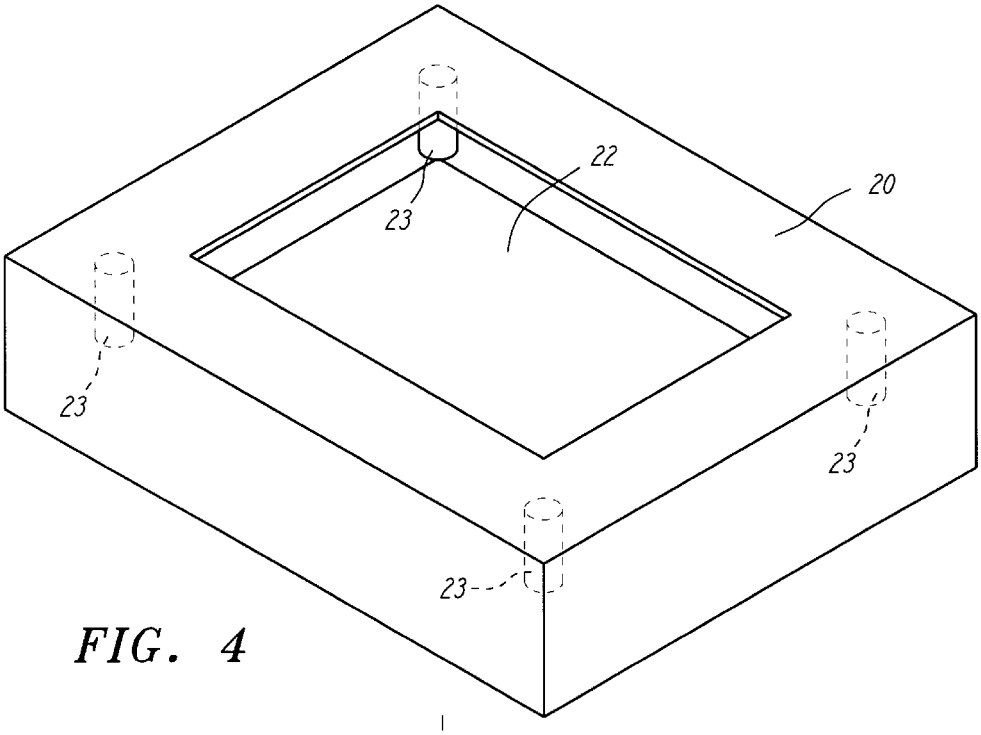
FIG. 4 is a perspective view of the housing employed by the present invention.

FIGS. 1–5 and 9 illustrate an illuminated display 10 constructed in accordance with the present invention. Display 10 includes a housing 20 and a base 21 fabricated from, e.g., plastic such as a high-impact, fire retardant engineering acrylic. In the preferred embodiment of the present invention, housing 20 is in the shape of a rectangular box, although other shapes will also work. As best seen in FIG. 4, the housing 20 has an opening 22 at its center and threaded posts 23 formed on the inside of the housing corners. A series of stand-offs 24 formed on base 21 match posts 23 in location and size. Each of the stand-offs 24 contains a bore. A series of fasteners 25, e.g., screws, can be inserted through the bores of stand-offs 24 and threaded into corresponding posts 23, thereby securing housing 20 to base 21.

A reflector 30 also preferably fabricated from a plastic such as acrylic is attached to the base 21 with a fastener 26. Fastener 26, which can be any suitable commercial device such as a bolt, screw, or the like, protrudes through a boss 31 in the bottom of the reflector and threads into boss 27 in the bottom of the base. A pair of cradles 28, 29 disposed on base 21 help support cradle 30. As depicted to best advantage in FIG. 4, the edges of the cradles are contoured to fit the underside of the reflector.

Turning to FIG. 2, reflector 30 can be seen to comprise an open-ended elongated body resembling a bath tub. In the preferred embodiment of the present invention, reflector 30 is in the shape of two spaced-apart longitudinal quadrants of a hollow cylinder intersected by a prism tangential to the cylinder. This geometry produces the reflector cross-section illustrated in FIG. 3, wherein curved sections 32, 33 of the reflector body are linked via a straight section 34 and transition to additional straight sections 35, 36 further up the sides of the reflector. Straight sections 35, 36, which are tangent to curved sections 32, 33 at points 37, 38, respectively, continue at an incline relative to straight section 34. The reflector body terminates in an open end across plane 39 at the top of straight sections 35, 36. If desired, rails 40 can be formed along the bottom of the reflector body to stabilize the reflector against the base 21 of the illuminated display.

In a preferred embodiment of the present invention, the length of straight sections 35, 36 is approximately 60% of the radius of curved sections 32, 33. Alternatively, the length of straight sections 35, 36 could be from approximately 50% to approximately 70% of the radius of curved sections 32, 33. The length of straight section 34 is approximately 20% of the radius of curved sections 32, 33. Alternatively, the length of straight section 34 could be from approximately 15% to approximately 25% of the radius of curved sections 32, 33. The angle of incline between straight section 34 and straight sections 35, 36 is approximately 45°, although this angle could range from approximately 35° to 55°.

Returning to FIG. 2, it can be observed that flat sides 42, 43 with elonged openings 44, 46 formed therein close off the ends of the reflector. Finally, a reflective coating 48 can be applied to the concave side of the reflector 30. Reflective coating 48 can be polished aluminum, polished silver, white paint, or the like. The reflective coating 48 need not be used if low reflection is desired.

Referring again to FIGS. 1 and 3, a light source 50 is inserted in the reflector 30 through openings 44 and 46 in sides 41 and 42. In the preferred embodiment of the present invention, light source 50 is an elongated fluorescent bulb. The longitudinal axis 51 of light source 50 is positioned slightly below the plane formed between tangent points 37, 38 on the reflector body. In a preferred embodiment of the present invention, this translates into a distance d below plane 39 equal to approximately 55% of the radius of curved sections 32, 33. Alternately, d could range from 45% to 65% of the radius of curved sections 32, 33.

A significant portion of the light generated by light source 50 reflects from the concave side of reflector 30, as seen in FIG. 3. Due to the geometry of reflector 30 and the positioning of light source 51, described above, this reflected light tends to concentrate at the corners 52 of the reflector body. Light directly radiated from light source 50, on the other hand, spreads across the entire plane 39 at the top of the reflector body, but tends to be less intense at the corners 52 than at the center of plane 39. The combination of reflected and direct light thus lends to an even distribution of luminance across the entirety of plane 39.

A translucent plate (e.g., "white" plate) 54 covered by a transparent plate 56 fits between the reflector 30 and the housing 20, parallel to plane 39 at the top of the reflector body. Plates 54 and 56 can, if desired, be made of glass. They can also be made of hard plastic or any other durable yet light-transmissive material, or they can be excluded altogether. The image 58 to be displayed is inserted across plane 39 between the two plates 54 and 56. Image 58 is exposed to an observer through opening 22 in housing 20 and top plate 56. The image 58 can be a photographic positive, such as a transparency. Alternatively, image 58 can be a photographic print, a slide, a negative, a sheet of paper, or another similar object.

As discussed above, the reflector 30 works together with the light source 50 to provide uniform luminance on the plane 39 of the image 58 (see the schematic shown in FIG. 3). The reflector 30 is designed such that more light is reflected to the sides of the image 58. On the other hand, the light source 50, being in the middle and closer to the center of the plane of the image 58, provides more direct luminance to the center of the image. By working in combination, the reflector 30 and the light source 50 provide uniform luminance to the entire plane of the image 58, thus backlighting the image for a pleasing and vivid visual effect.

Figure 1:
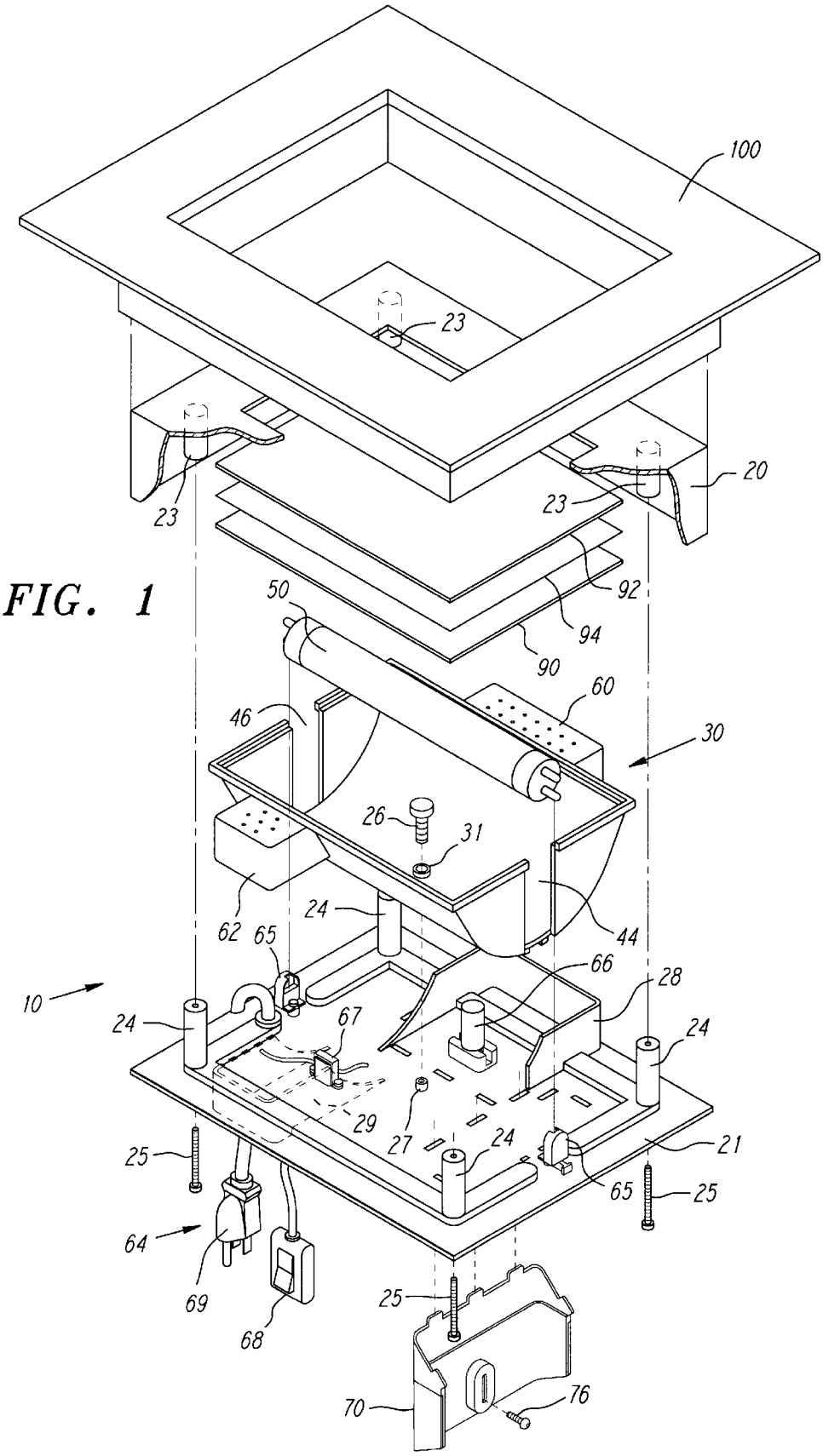
FIG. 1 is an exploded view of the present invention.

Simple electronic components 64 such as contacts 65, transformer 66, starter 67, on/off switch 68, and electrical cord 69, all illustrated in FIG. 1, power the light source 50 in conventional fashion. Components 64 are attached to the base 21, with transformer 66 protected by cradle 28 and starter 67 protected by cradle 29. If desired, a pair of skirts 60, 62 which respectively mate with cradles 28, 29 can be formed on reflector 30 to completely cover the transformer and starter. In this manner, the components 64 are protectively enclosed inside housing 20. The light source can alternatively be powered by batteries, solar cells, or any other power means.

Figure 6:
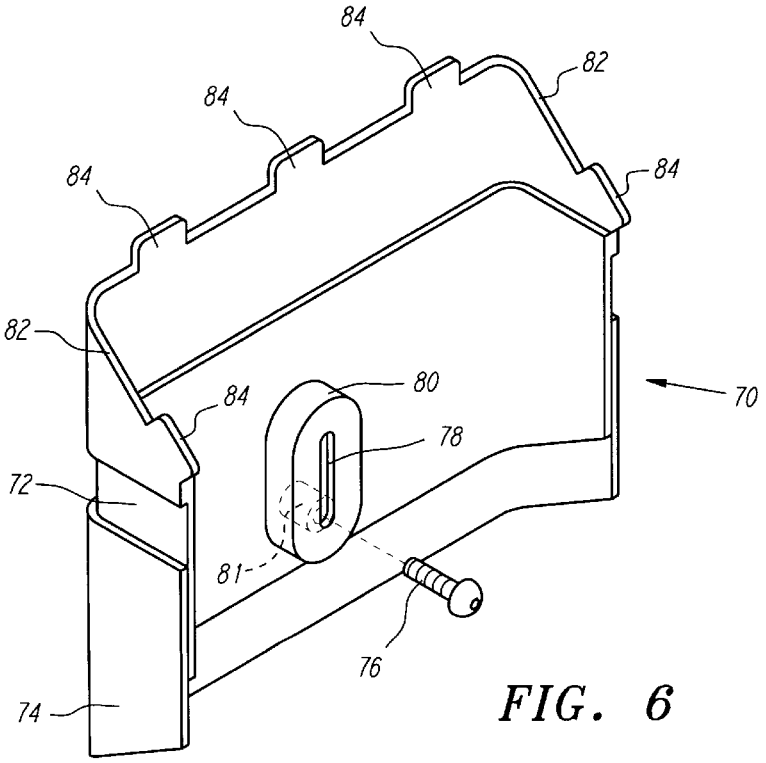
FIG. 6 is a perspective view of the adjustable stand employed by the present invention.

An adjustable positioning structure or stand 70 is connected to the base 21 or the housing 20. As best seen in FIG. 6, in the preferred embodiment of the present invention, positioning structure 70 is an adjustable stand attached to the base 21. The stand includes a pair of channel-shaped members 72, 74. Member 72 nests within member 74 such that both members can telescope relative to one another. A screw 76 or similar fastener is inserted through a slot 78 formed in a hollowed-out lug 80 on member 72 and threads into a matching nut 81 attached to the underside of member 74. Thus, the length of stand 70 can be adjusted by moving member 72 to the desired position within member 74 and tightening screw 76 to clamp the two members together.

Figure 5:
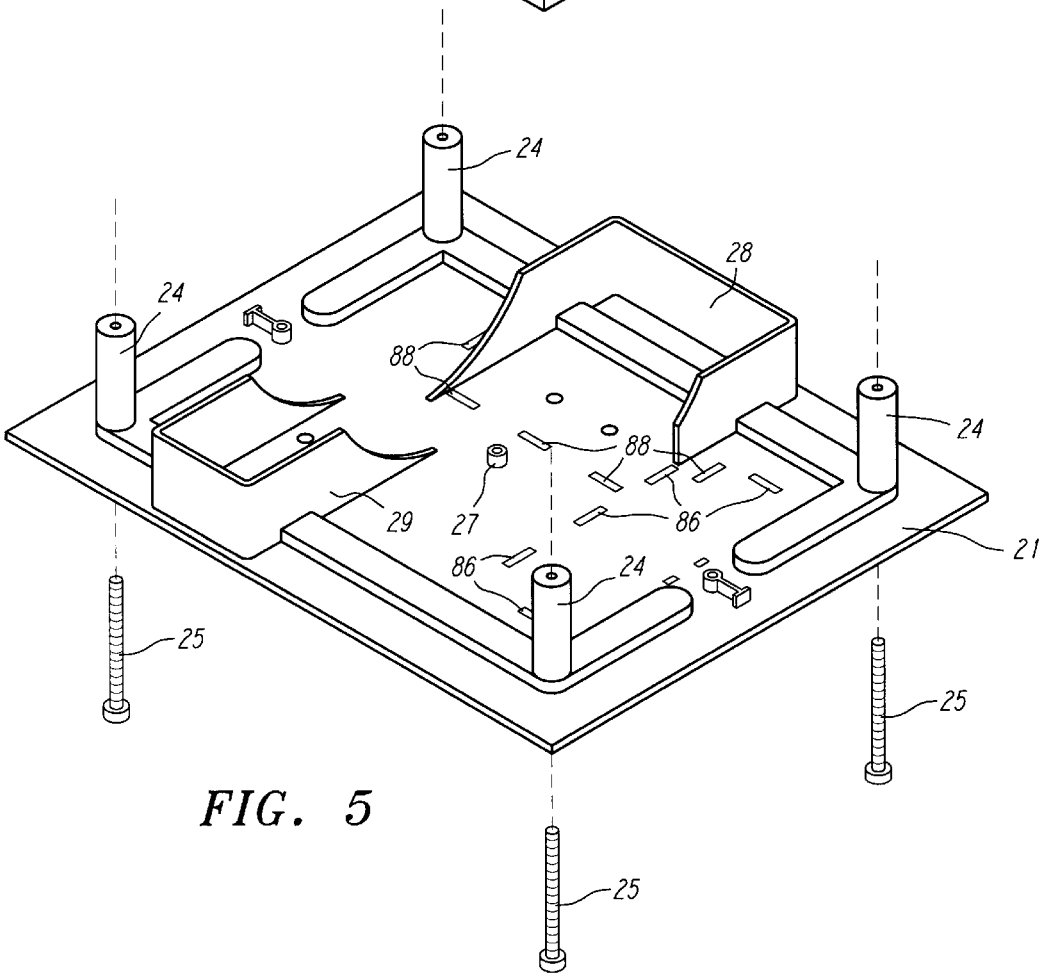
FIG. 5 is a perspective view of the base employed by the present invention.
Figure 7:
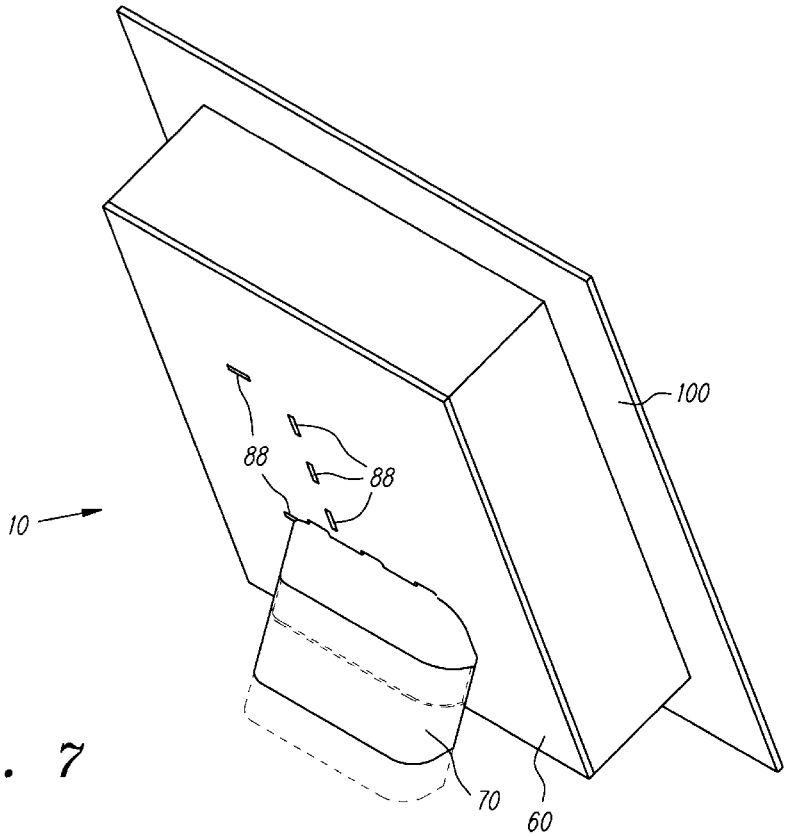
FIG. 7 is a perspective rear view of the present invention in a vertical configuration.

The adjustable length operation of stand 70 can be further understood with reference to FIGS. 5–7. The top of member 72 is beveled, as can be seen at 82. A set of tabs 84 are formed on the bevel. Tabs 84 can be inserted into slots 86 formed in base 21. The dimensions of tabs 84 are selected to provide for a compression fit in slots 86. The angle of the bevel 82 at the top edge of member 72 causes the stand 70 to project outward from base 21 when tabs 84 have been inserted into slots 86, as seen to best advantage in FIG. 7. This configuration enables the stand to stabilize and support the base 21 and attached housing 20 on any suitable flat surface, e.g., a table top or desk top, in order to display an image in vertical fashion. Resetting screw 76 in slot 78 to extend or retract member 72 relative to member 74 allows the user to adjust the angle of stand 70, and hence the angle of the image plane in reflector 30 relative to the surface on which the display 10 rests.

Figure 8:
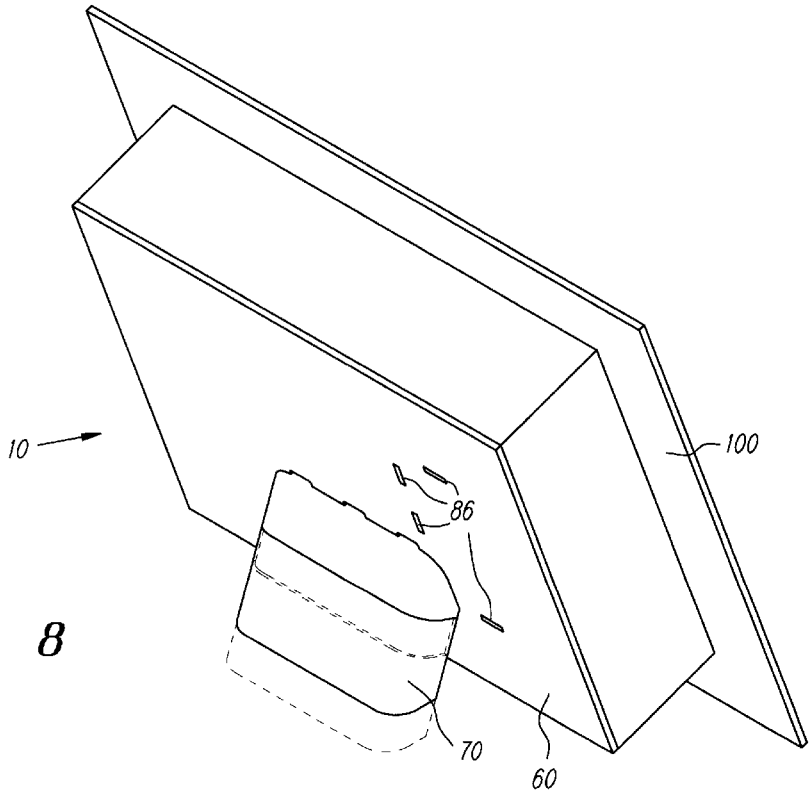
FIG. 8 is a perspective rear view of the present invention in a horizontal configuration.
Figure 9:
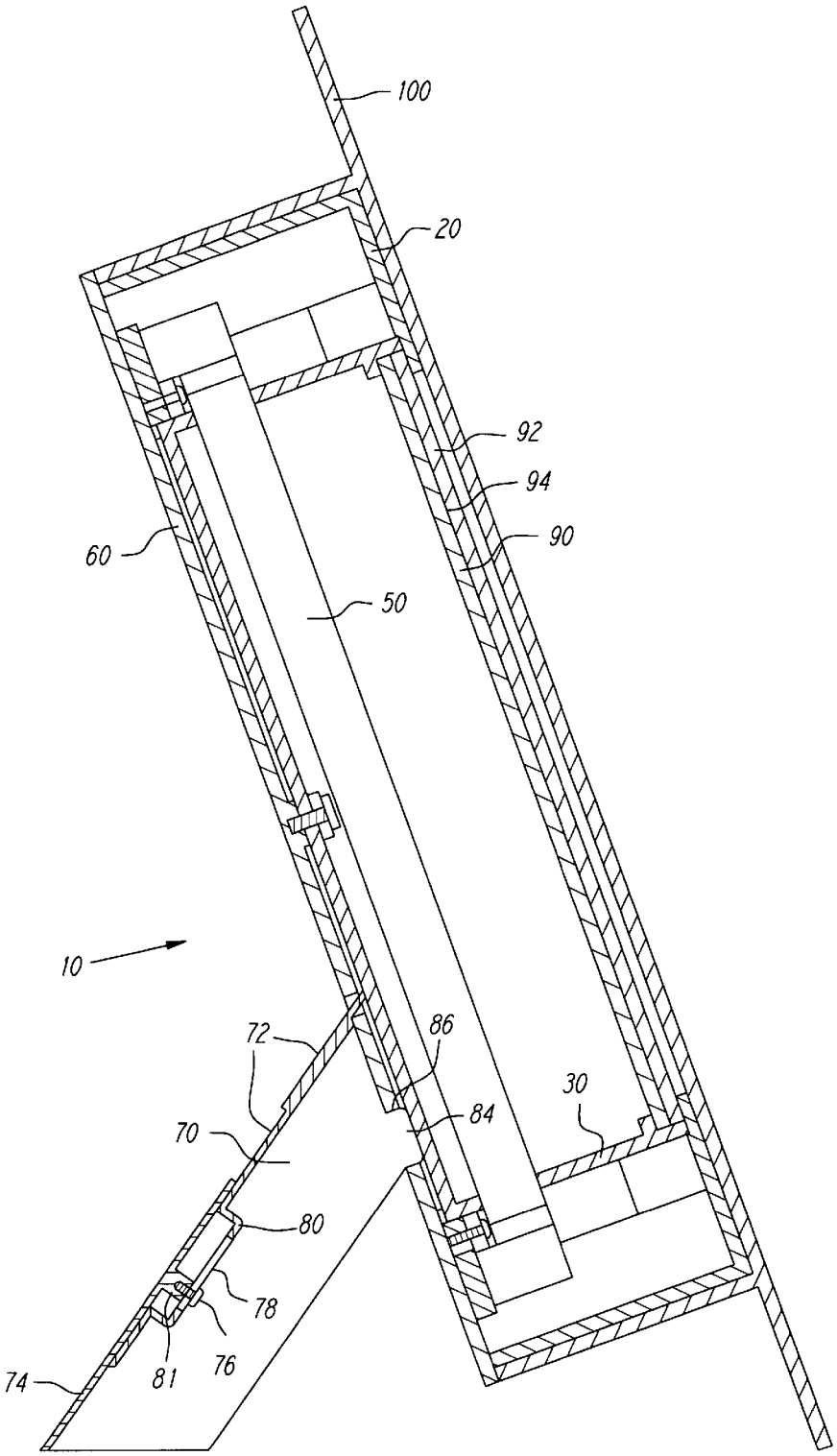
FIG. 9 is a longitudinal cross-section through the center of present invention.

If desired, a second set of slots 88 can also be formed in base 21 at right angles to slots 86. As seen in FIG. 8, this second set of slots enables the user to shift the orientation of the stand by 90°, in turn allowing housing 20 to be rotated for displaying an image horizontally rather than vertically.

In the preferred embodiment of the present invention, therefore, stand 70 is designed to support the illuminated display 10 on a piece of furniture in any position desired by a user. However, the present invention can operate without the positioning structure 70 or the base 21. In that event, housing 20 may provide support for the display. Alternatively, a hook attached to the base 21 or the housing 20 will allow the illuminated display 10 to be hung from a wall.

Finally, an interchangeable frame 100 slides over the top surface of the housing 20 to provide a decorative border for the illuminated display 10. The interchangeable frame 100 can be of various shapes and sizes to please the tastes of an individual user and to match the image 58 displayed.

Thus, an illuminated display is disclosed where the shape of a reflector is optimized to provide uniform luminance on the plane of an image. Adjustable positioning means and an interchangeable frame are used to make the display as functionally practical and as aesthetically pleasing as a conventional picture frame. While embodiments and applications of this invention have been shown and described, it would be apparent to those skilled in the art that many more modifications are possible without departing from the inventive concepts herein. The invention, therefore, is not to be restricted except in the spirit of the appended claims.

We claim:

1. An illuminated display, comprising:

at least one light source; and a reflector structure facing said light source, said reflector structure including an image plane oriented to receive direct light from said light source and reflected light from said reflector structure, said reflector structure also including alternating curved and straight sections forming a continuous reflective surface which terminates in straight sections intersecting said image plane to provide said reflected light such that said reflected light combines in said image plane with direct light from said light source to impart uniform luminance on said image plane.

2. An illuminated display according to claim 1 wherein said reflector structure is shaped as a longitudinal section of a hollow elongated body with a cross-section that has a varying radius.

3. An illuminated display according to claim 1 wherein said reflector structure is shaped as a longitudinal section of a hollow elongated body with a cross-section that has said alternating straight and curved sections.

4. An illuminated display, comprising:

at least one light source;

a reflector structure having a reflective surface facing said light source and an image plane oriented to receive direct light from said light source and reflected light from said reflective surface, said reflector structure including alternating straight and curved sections which provide reflected light such that said reflected light combines in said image plane with direct light from said light source to impart uniform luminance on said image plane, said reflector structure is shaped as two quadrants of a longitudinal section of a hollow cylinder intersected by a prism tangential to the cylinder.

5. An illuminated display according to claim 1, further comprising:

a housing having an opening parallel to said image plane.

6. An illuminated display according to claim 5, further comprising:

a plurality of transparent plates arranged between said light source and said housing.

7. An illuminated display according to claim 5, further comprising:

an interchangeable frame selectively superposed over said housing.

8. An illuminated display, comprising:

at least one light source;

a reflector structure having a reflective surface facing said light source and an image plane oriented to receive direct light from said light source and reflected light from said reflective surface, said reflector structure including alternating straight and curved sections which provide reflected light such that said reflected light combines in said image plane with direct light from said light source to impart uniform luminance on said image plane;

a housing having an opening parallel to said image plane; and an adjustable positioning structure attached to one of said housing and said reflector structure.

9. An illuminated display, comprising:

at least one light source;

a reflector structure having a reflective surface facing said light source and an image plane oriented to receive direct light from said light source and reflected light from said reflective surface, said reflector structure including alternating straight and curved sections which provide reflected light such that said reflected light combines in said image plane with direct light from said light source to impart uniform luminance on said image plane;

a housing having an opening parallel to said image plane; and a base attached to said housing and arranged on a side of said reflector structure opposite said light source, said base including a plurality of slots.

10. An illuminated display according to claim 9, further comprising:

an adjustable positioning structure attached to said base.

11. An illuminated display according to claim 10, wherein said adjustable positioning structure comprises:

a plurality of telescoping members including an outermost member;

a fastener securing said telescoping members together and alternatively allowing said telescoping members to slide relative to one another or lock said telescoping members against such sliding; and a plurality of tabs attached to said outermost telescoping member, said tabs adapted to be inserted into said slots in said base to attach said adjustable positioning structure to said base.

12. An illuminated display according to claim 11, further comprising:

a plurality of transparent plates arranged between said light source and said housing; and an interchangeable frame selectively superposed over said housing.

13. An illuminated display, comprising:

a housing having an opening;

a reflector structure attached to said housing, said reflector structure shaped as a longitudinal section of a hollow elongated body with a cross-section that has a plurality of curved sections and a plurality of straight sections;

at least one light source arranged over said reflector structure, said reflector structure operating together with said light source to impart uniform luminance on a plane containing said opening of said housing;

a base attached to said housing and arranged on a side of said reflector structure opposite said light source; and adjustable positioning structure attached to one of said base, said housing, and said reflector structure.

14. An illuminated display according to claim 13, further comprising:

an interchangeable frame selectively superposed over said housing.

15. An illuminated display according to claim 13, further comprising:

a plurality of transparent plates arranged between said reflector structure and said housing.

* * * * *